United States Patent [19]

Celender et al.

[11] 4,319,700

[45] Mar. 16, 1982

[54] MULTI-SIZE PILL DISPENSER

[76] Inventors: Richard A. Celender; Alexander Fedorovich, both of 2164 Almshouse Rd., Jamison, Pa. 18929

[21] Appl. No.: 910,482

[22] Filed: May 30, 1978

[51] Int. Cl.[3] ..... B65D 83/04

[52] U.S. Cl. ..... 222/511; 222/559; 221/312 R

[58] Field of Search ..... 222/43, 310, 511, 559; 221/312 R, 131

[56] References Cited

U.S. PATENT DOCUMENTS

| | | | |
|---|---|---|---|
| 262,214 | 8/1882 | Fleming | 222/511 |
| 443,254 | 12/1890 | Gilliland | 194/93 |
| 728,522 | 5/1903 | Ulbricht | 221/256 |
| 1,173,069 | 2/1916 | Walker | 221/147 |
| 1,682,629 | 8/1928 | Rossi | 221/200 |
| 2,086,296 | 7/1937 | Gilbert | 221/255 |
| 2,119,912 | 6/1938 | Fuselier | 221/255 |
| 2,173,537 | 9/1939 | Lewis | 222/511 |
| 2,187,218 | 1/1940 | Witt | 221/147 |
| 2,635,026 | 4/1953 | Kreul | 221/255 |
| 2,669,349 | 2/1954 | Silver | 221/202 |
| 2,717,725 | 9/1955 | Bennett | 222/511 X |
| 2,968,264 | 1/1961 | Schnell | 222/511 X |

*Primary Examiner*—Joseph J. Rolla

[57] ABSTRACT

A multi-size pill dispenser comprises an enclosing cabinet within which are formed a plurality of horizontally juxtaposed pill containing hoppers. Each hopper terminates downwardly in a square opening through which the pills can drop by gravity. A slide is reciprocal below each hopper and includes a triangularly shaped window, portions of which can be urged into registry beneath the hopper opening. An adjustable stop is provided to limit the forward movement of the slide relative to the hopper opening whereby the area of the slide triangular window which can be pulled into registry below the hopper opening can be precisely controlled to regulate both the size and number of pills that can be dispensed from each hopper upon each reciprocation of a slide. By adjusting the forward limit of travel of each of the slides, various sizes and types of pills or other articles can be dispensed, one at a time, from the plurality of hoppers.

3 Claims, 5 Drawing Figures

MULTI-SIZE PILL DISPENSER

BACKGROUND OF THE INVENTION

The present invention relates generally to the field of article dispensers and more particularly is directed to a pill dispenser suitable to deliver a plurality of different size pills within a limited area.

Prior workers in the art have developed various types of article dispensers, most of which have been particularly designed to dispense similar articles one at a time upon operation of a reciprocating mechanism. For example, U.S. Pat. No. 2,635,026 discloses a dispensing apparatus suitable to convey gaskets one at a time, upon each reciprocation of a sliding member. Similarly, matches can be delivered one at a time in the manner disclosed in U.S. Pat. No. 1,173,069 upon reciprocation of a suitable delivering member. A similar apparatus is taught in U.S. Pat. No. 2,187,218 wherein an inclined hopper is illustrated holding a plurality of cigarettes wherein the device includes a drawer which is reciprocal below the hopper to deliver one cigarette upon each reciprocation of the drawer.

While the prior art devices known are generally suitable to deliver objects of known size for which the apparatus can be predesigned, such prior art devices cannot be readily adjusted to accommodate articles of different sizes or different configurations. Additionally, the prior art dispensers of which we are aware cannot be readily arranged to dispense, in a limited size area, a plurality of similar but dimensionally different objects. For example, pills, capsules or other small articles of various size, contents and configurations.

SUMMARY OF THE INVENTION

The present invention relates generally to the field of pill dispensers and more particularly is directed to a multi-compartment pill dispenser suitable for dispensing pills or other articles of various sizes.

The device of the present invention incorporates an enclosing housing or cabinet including an open top and a closed floor. A molded or otherwise formed insert which is subdivided into a plurality of pill containing hoppers is positioned within the enclosure in a manner to form a plurality of discrete compartments for containing different pills of varying sizes, contents or configurations. Each hopper is formed to function as a funnel or chute to lead the pills by gravity toward a bottom opening provided in the floor of the container. In the preferred embodiment, the bottom openings are formed to a square configuration of size considerably larger than the size of pills being dispensed.

Each hopper is equipped with a reciprocal slide assembly which bottomly overfits the floor of the enclosing container and is reciprocal relative thereto. Each slide comprises an operating handle which extends from the slide body, a stop means which may be integral with the slide body and a slide window which is generally forwardly positioned in a manner to permit registry of at least a portion of the slide window below the hopper opening when the slide is urged to a forward position by pulling on the integral handle. A spring or other resilient member preferably is provided to continuously bias the slide to a rearward position whereby the slide window does not register below the hopper opening.

In the preferred embodiment, the slide window is formed in the configuration of a triangle with the apex of the triangle pointing forwardly. Thus, when the slide is functioned forwardly, increasingly sized triangularly configured areas of the slide window will be pulled into registry below the hopper opening. An adjustable position abutment is provided in the enclosure floor in position to be contacted by the slide stop means to limit the forward movement of the slide during reciprocation thereof for article dispensing purposes. Accordingly, the size of the window area exposed in registry below the hopper opening can be precisely controlled by varying the location of the abutment to accommodate pills or other articles of various sizes.

The maximum size article which could be dispensed by the apparatus would be the maximum clear area of the slide triangular window that could be positioned in registry below the hopper opening. The size of the clear area could then be infinitely varied downwardly from the maximum to complete closure by adjusting the size of triangular window that could be pulled into registry below the hopper opening by adjustment of the abutment location.

It is therefore an object of the present invention to provide an improved multi-size pill dispenser of the type set forth.

It is another object of the present invention to provide a novel multi-size pill dispenser including a plurality of pill container hoppers in side by side juxtaposition.

It is another object of the present invention to provide a novel multi-size pill dispenser comprising readily adjustable means capable of dispensing pills of various sizes.

It is another object of the present invention to provide a novel multi-size pill dispenser comprising a plurality of pill containing hoppers in side by side juxtaposition and variable valve means reciprocal beneath each hopper to dispense pills or other objects of different sizes.

It is another object of the present invention to provide a novel multi-size pill dispenser that is simple in construction, inexpensive in manufacture and readily adjustable when in use.

Other objects and a fuller understanding of the invention will be had by referring to the following description and claims of a preferred embodiment thereof, taken in conjunction with the accompanying drawings, wherein like reference characters refer to slimilar parts throughout the several views and in which:

DESCRIPTION OF THE PREFERRED EMBODIMENTS OF THE INVENTION

Figure 1:
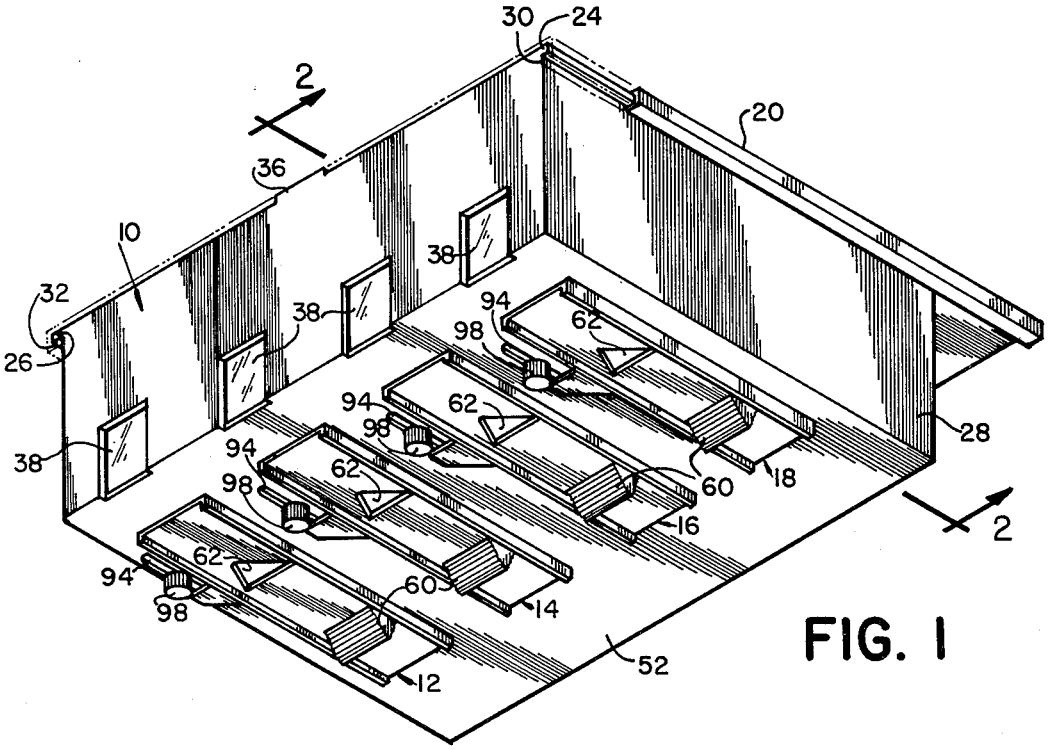
FIG. 1 is a perspective view of the pill dispenser in accordance with the present invention.

Although specific terms are used in the following description for the sake of clarity, these terms are intended to refer only to the particular structure of the invention selected for illustration in the drawings and are not intended to define or limit the scope of the invention.

Referring now to the drawings, there is shown in FIG. 1 a pill dispenser 10 which is particularly suitable for dispensing various size pills. In the embodiment illustrated, four separate pill dispensing assemblies 12, 14, 16, 18 are illustrated in side by side relationship. However, it will be appreciated that the device may include more or fewer pill dispensing assemblies for delivery of more or fewer types of pills and still fall within the meaning and scope of this invention.

Figure 2:
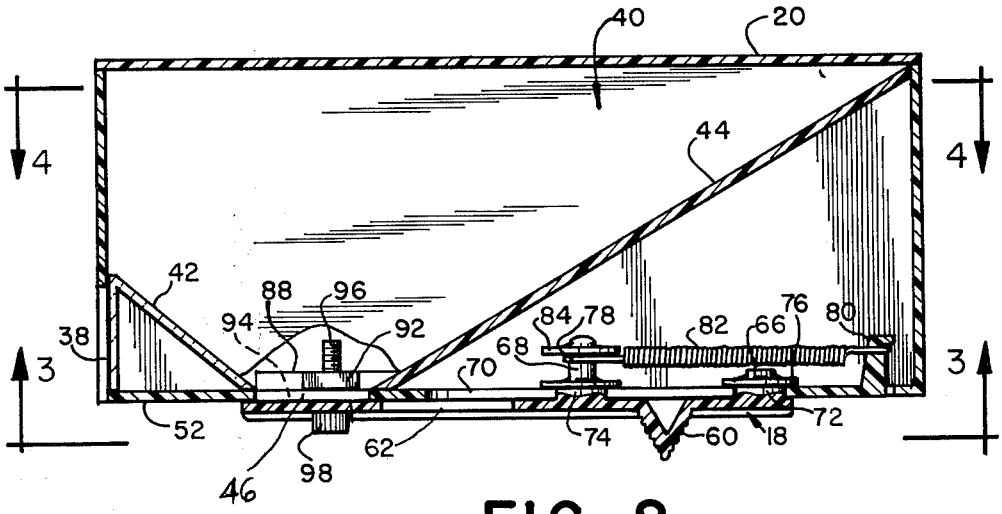
FIG. 2 is a cross sectional view taken along line 2—2 of FIG. 1, looking in the direction of the arrows.
Figure 5:
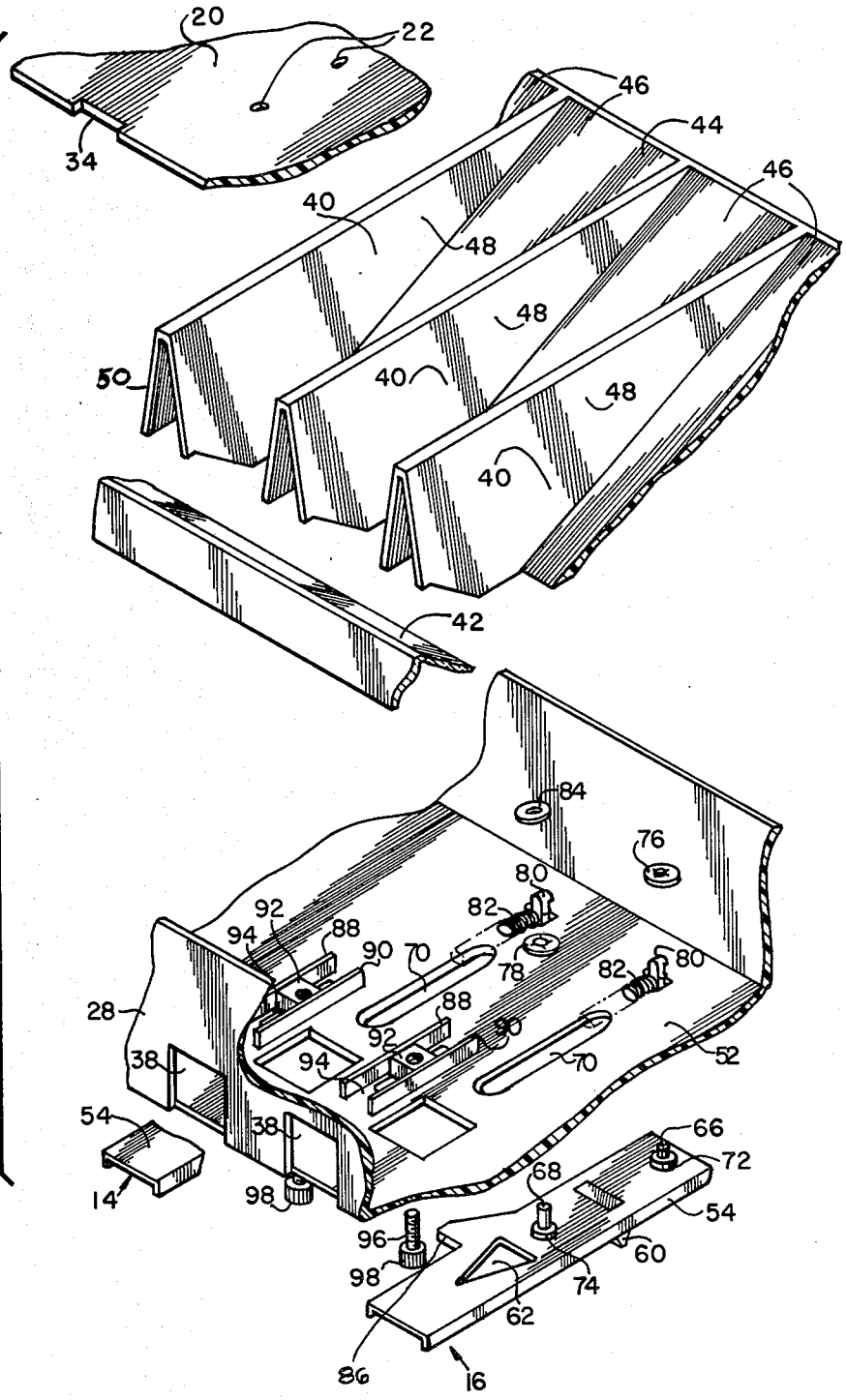
FIG. 5 is a perspective, partial, exploded view of the invention, portions of which have been broken away to disclose interior construction details.

As illustrated in FIGS. 1, 2 and 5, the pill dispenser 10 comprises generally a mounting lid 20 which may be provided with a plurality of spaced openings 22 to facilitate affixing the lid to a permanent construction member (not illustrated) such as the underside of a kitchen shelf or cabinet. The lid 20 may be molded, bent or otherwise formed to provide a pair of transversely opposed tracks 30,32 to slidingly receive the edges of the enclosing cabinet 28 therewithin for mounting purposes. The cabinet 28 is upwardly formed with transversely opposed ridges or edges 24,26 which are a sliding fit within the respective tracks 30,32. In the preferred embodiment, the lid 20 is formed with front and rear recesses 34 and the cabinet 28 is provided with aligned front and rear tabs 36 of suitable configuration to snap into the respective recesses to hold the cabinet in position for article delivery.

Figure 4:
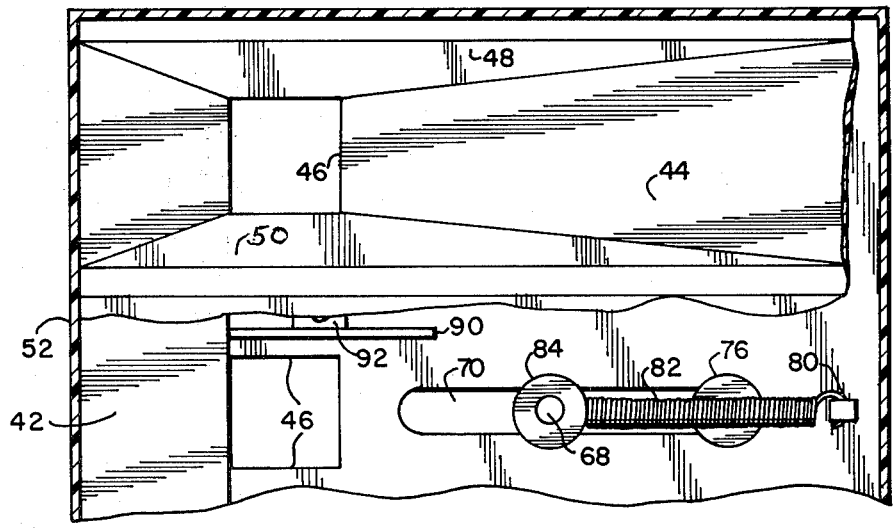
FIG. 4 is a partial, cross sectional view taken along line 4—4 of FIG. 2, looking in the direction of the arrows, partly broken away to expose interior construction details.

The cabinet 28 is also provided with a clear inspection port 38 in alignment with each interior hopper to allow easy visual inspection to determine the quantity of pills or other articles remaining in each hopper. Each hopper 40 is defined by front and rear walls 42, 44 which slope inwardly and downwardly toward the bottom positioned pill dispensing opening 46. As best seen in FIG. 4, the pill dispensing opening 46 is preferably rectangular in configuration and of size to easily pass the largest type of pill contemplated for use with the dispenser 10. As illustrated in FIG. 5, each hopper 40 is transversely defined by inwardly sloping right and left sidewalls 48, 50 which are also configured to direct the pills (not shown) to fall by gravity toward the bottom positioned hopper opening 46.

Referring now to FIGS. 1 and 2, it will be observed that each pill hopper 40 is provided with a pill dispensing assembly 12, 14, 16 or 18 which bottomly overfits the floor 52 of the enclosing cabinet 28 for pill dispensing purposes. Each pill dispensing assembly 12, 14, 16, 18 comprises a planar slide 54 which is longitudinally reciprocal between a pill storing position 56 as illustrated at the top and bottom dispensers in FIG. 3 to a pill dispensing position 58 as illustrated in the middle dispenser shown in FIG. 3.

Figure 3:
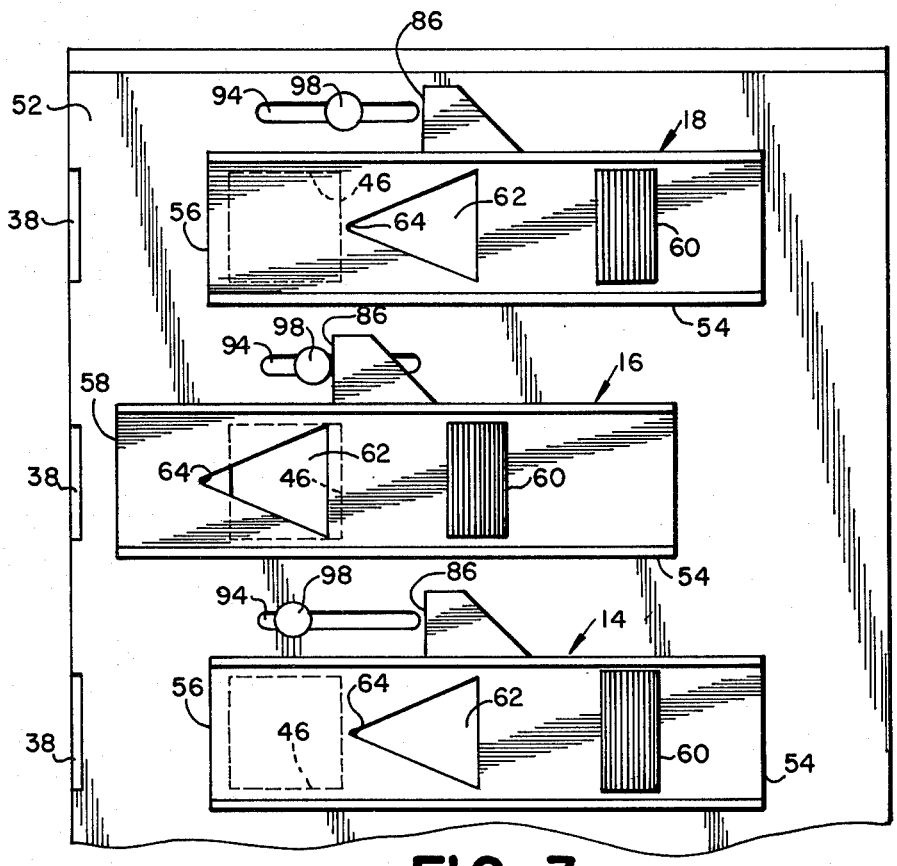
FIG. 3 is a partial, bottom plan view of the pill dispenser, looking from line 3—3 of FIG. 2.

Each slide 54 is provided with a projecting operating handle 60 which may be integrally molded or which may be separately fabricated and then suitably attached, for example, by adhesives or threaded fasteners (not illustrated). Each slide 54 is forwardly provided with an article dispensing window 62 which preferably is triangular in configuration with the triangle apex facing forwardly. Referring to FIG. 3, it will be observed that as the slide 54 is reciprocated forwardly by applying forward pressure to the operating handle or projection 60, the triangularly shaped window 62 will be pulled into registry below the associated, cooperating rectangular hopper opening 46. Due to the triangular configuration of the window 62, it will be observed that as the window apex 64 is pulled forwardly below the rectangular opening 46, more and more free area of the window 62 will be pulled into registry below the opening 46 to thereby permit larger and larger pills (not shown) to drop through the registered openings 46, 62. Accordingly, when smaller pills are to be dispensed, only a small portion of the window 62 need be pulled into registry below the opening 46. Similarly, when larger pills or other objects (not illustrated) are to be dispensed from the hopper 40, then the slide 54 should be urged forwardly a greater distance to thus expose a greater area of the triangular window 62 in registry below the rectangular opening 46. The maximum size pill that can then be accommodated will be governed by the size of the slide window 62 that can be pulled into registry below the hopper opening 46.

To facilitate pill dispensing reciprocation, each slide 54 is provided with rearward and forward upwardly projecting studs 66, 68 which project upwardly through the elongated openings 70 which are formed in the cabinet floor 52. Suitable bushings 72, 74 can be provided overfitting the studs 66, 68 to permit longitudinal sliding reciprocation within the elongated opening 70. As best seen in FIGS. 2 and 5, lock washers 76, 78 or other suitable fasteners attach to the respective studs 66, 68 above the cabinet floor 52 to retain the parts together during all reciprocal movements of the slide 54 between the pill storing position 56 and the pill dispensing position 58.

Still referring to FIGS. 2 and 5, it will be seen that the cabinet floor 52 is rearwardly provided with upwardly projecting finger 80 in alignment with the elongated slots 70 for spring attachment purposes. Preferably, each forwardly positioned stud 68 is elongated sufficiently to provide a forward means of attachment for an operating spring 82. As illustrated, each spring 82 biases between a rear finger 80 and a forward stud 68 for slide functioning purposes. It will be noted that the rear upwardly projecting finger 80 includes a rearwardly projecting lip to maintain the spring end in position. A press nut 84 overfits the end of the forward stud 68 to retain the spring end in association with the stud 68. The operating spring 82 is arranged to normally bias the slide 54 to its rearward, pill storing position 56. By pulling forwardly on the operating handle or lever 60, with force sufficient to overcome the bias of the spring 82, the slide 54 can be forwardly urged to the pill dispensing position 58 (see FIG. 3). After a pill (not shown) has been dispensed through the registered openings 46, 62, upon releasing forward pressure on the lever 60, the spring 82 will function automatically to normally pull the slide 54 rearwardly to the pill storing position 56.

Each slide 54 is provided with an integrally formed or otherwise attached, transversely extending stop 86 which is designed to reciprocate in unison with the reciprocal movements of the slide 54. As best seen in FIGS. 2 and 5, the cabinet floor 52 is provided with spaced pairs of ridges 88, 90 which are spaced apart sufficiently to secure a nut 92 therebetween. The cabinet floor 52, between the ridges 88, 90 is machined or otherwise formed to provide elongated openings 94 for stop adjustment purposes as herein more fully explained. A thumb screw 96 with knurled head 98 inserts upwardly through the elongated opening 94 and threadedly engages the nut 92 from below. It is noteworthy that the ridges 88, 90 are spaced apart just sufficiently to permit the nut 92 to fit therebetween to prevent the nut from turning as the thumb nut 96 is tightened. Accordingly, the position of the bottomly exposed head 98 of the thumb screw can be relatively longitudinally adjusted along the elongated slot 94 by first loosening the screw 96 relative to the nut 92 and then longitudinally moving the combined nut and screw until the desired longitudinal position is determined. The parts can be secured by tightening in usual manner.

As best seen in FIGS. 3 and 5, the slide stop surface 86 transversely extends from the slide 54 sufficiently to engage the thumb screw head 98 when the slide 54 is forwardly pulled toward the dispensing position 58. By judiciously adjusting the position of the thumb screw 96 within the elongated slot 94 by tightening against its associated nut 92, the exposed area of window 62 that can be pulled into registry below the rectangular hopper opening 46 can be precisely controlled. Thus, as the thumb screw 96 is positioned more forwardly along the elongated floor opening 94, the slide 54 can be more forwardly urged during each reciprocation for pill dispensing purposes. As hereinbefore set forth, the apex 64 of the triangular window 62 is forwardly positioned and accordingly, as the slide 54 is more forwardly urged, the greater amount of window is exposed below the hopper opening 46, thereby to dispense pills or other articles of increasing sizes.

After the slide has been forwardly pulled to the pill dispensing position 58 to dispense a pill (not shown), release of finger pressure on the lever 60 will allow the operating spring 82 to automatically pull the slide rearwardly to the pill storing position 56. See FIG. 3.

Thus, it is seen that by adjusting the position of the various thumb screws 96 of the respective pill dispensing assemblies 12, 14, 16, 18, the relative pill dispensing positions 58 of each pill dispensing assembly can be adjusted for any type or size of pill being dispensed. For example, should a small pill, for example, saccharin be stored in one of the pill dispensing assembly hoppers, then the thumb screw 96 of that dispensing assembly will be relatively rearwardly positioned within its associated elongated floor opening 94 to thereby expose only a small portion of the window 62 as the triangular window apex 64 is pulled into registry beneath the hopper opening 46. Another of the hoppers could be provided with larger pills, for example, aspirin tablets. Another could be adjusted to dispense vitamins and other articles of different sizes, such as particular medicines, capsules, candy and the like.

Although the present invention has been described with a certain degree of particularity, it is understood that the present disclosure has been made only by way of example and that numerous changes in the details of construction and the combination and arrangement of parts may be made without departing from the spirit and scope of the invention as hereinafter claimed.

What is claimed is:

1. In an article dispenser suitable to dispense articles of different sizes, the combination of a cabinet comprising at least one opening of a first configuration, and at least one article-containing hopper including funnel means to converge articles downwardly toward said opening; and adjustable valve means underlying the cabinet at said opening to permit articles to be dispensed from the hopper through the opening, said valve means comprising a slide reciprocally moveable between a rearward article-storing position and a forward article-dispensing position and having a window therein of a second configuration, at least a part of said window being pulled into registry beneath the opening when the slide is urged to its forward position to dispense at least one article, said valve means being adjustable by means of an abutment projecting from the cabinet and a stop on said slide, the abutment and said stop being aligned to permit the stop to contact the abutment upon each forward movement of the slide to the article-dispensing position to limit the forward extent of travel of the slide, said abutment comprising means to adjust the position thereof relative to the cabinet to permit variation in the limit of forward travel of the slide by relocation of said abutment in any position between a first adjusted position wherein the entire slide window is in registry below the hopper opening and a second adjusted position wherein none of the window can be pulled into registry below the hopper opening, the improvement comprising, said cabinet being provided with a first elongated slot within which a portion of said valve means is adapted to reciprocate longitudinally, and a second elongated slot laterally offset from said first slot, a portion of the means to adjust the abutment position being longitudinally adjustable within said second slot.

2. The article dispenser of claim 1 wherein the second slot is lined with a pair of spaced longitudinal ridges and the means to adjust comprises a thumb screw and a nut, the said ridges being spaced apart a distance sufficient to receive the nut therebetween to prevent the nut from turning when the thumb screw is turned.

3. The article dispenser of claim 2 wherein the nut is positioned interiorly of the cabinet and the thumb screw projects exteriorly of the cabinet.

* * * * *